US007000800B2

(12) United States Patent
Boudry

(10) Patent No.: US 7,000,800 B2
(45) Date of Patent: Feb. 21, 2006

(54) STORAGE TANK ASSEMBLY

(75) Inventor: John A. Boudry, Brettenham (GB)

(73) Assignee: Cookson and Zinn (PTL) Limited, (GB)

( * ) Notice: Subject to any disclaimer, the term of this patent is extended or adjusted under 35 U.S.C. 154(b) by 128 days.

(21) Appl. No.: 10/221,902

(22) PCT Filed: Mar. 16, 2001

(86) PCT No.: PCT/GB01/01159

§ 371 (c)(1),
(2), (4) Date: Dec. 19, 2002

(87) PCT Pub. No.: WO01/68510

PCT Pub. Date: Sep. 20, 2001

(65) Prior Publication Data

US 2004/0020933 A1 Feb. 5, 2004

(30) Foreign Application Priority Data

Mar. 16, 2000 (GB) ..... 0006192

(51) Int. Cl.
*B65D 88/00* (2006.01)

*B65D 90/00* (2006.01)

(52) U.S. Cl. ..... 220/567.2; 220/567.1

(58) Field of Classification Search ..... 220/862, 220/4.14, 4.12, 648, 649, 1.5, 636, 638, 562, 220/567, 567.1, 567.2; 405/52; 137/234.6; 211/85.18, 85.22, 49.1, 194; 248/638, 676, 248/154

See application file for complete search history.

(56) References Cited

U.S. PATENT DOCUMENTS

| | | | | |
|---|---|---|---|---|
| 4,901,748 A | | 2/1990 | Shotmeyer | 137/234.6 |
| 4,911,326 A | | 3/1990 | McGouran, Jr. | 220/445 |
| 5,308,423 A | * | 5/1994 | Kauffman | 156/171 |
| 5,526,964 A | * | 6/1996 | Moore et al. | 222/383.1 |
| 5,865,346 A | | 2/1999 | Del Zotto | 222/108 |
| 5,921,712 A | | 7/1999 | Wokas | 405/52 |
| 6,079,580 A | * | 6/2000 | Garton et al. | 220/1.5 |
| 6,105,602 A | * | 8/2000 | Sistonen | 137/234.6 |
| 6,109,290 A | | 8/2000 | Sabatinelli | 137/234.6 |
| 6,161,272 A | * | 12/2000 | Madison | 29/469 |

FOREIGN PATENT DOCUMENTS

GB 2 325 456 11/1998

* cited by examiner

*Primary Examiner*—Nathan J. Newhouse
*Assistant Examiner*—Harry Grosso
(74) *Attorney, Agent, or Firm*—Sheridan Ross PC

(57) ABSTRACT

According to the present invention there is provided a storage tank assembly comprising: (i) a storage tank; (ii) support means comprising at least one load bearing reinforcement means extending around and attached to at least a portion of the outer circumference of the storage tank, the support means further incorporating at least one mounting leg to enable the support means to be connected to a canopy.

24 Claims, 13 Drawing Sheets

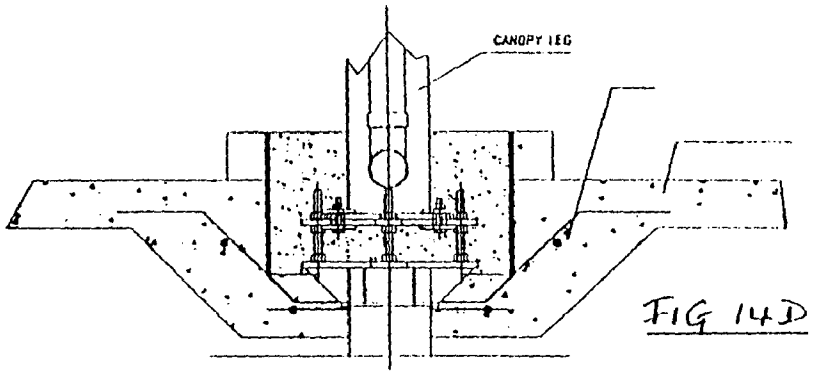
FIG 14D
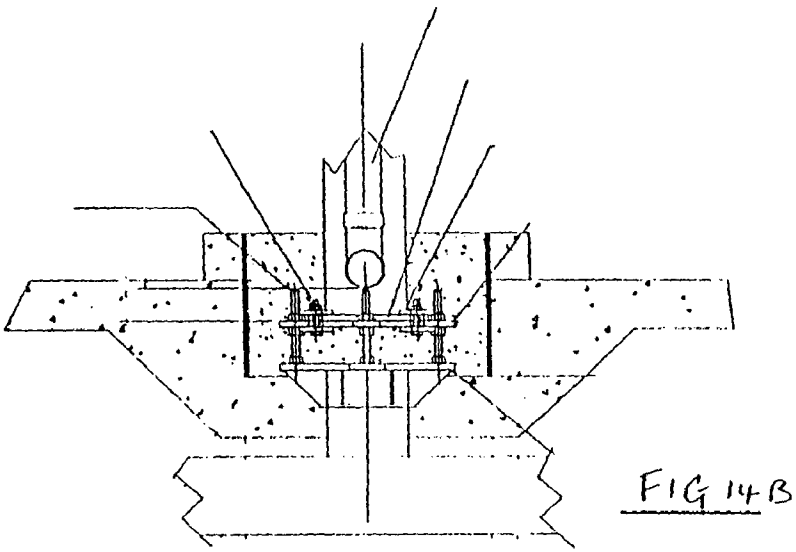
FIG 14B
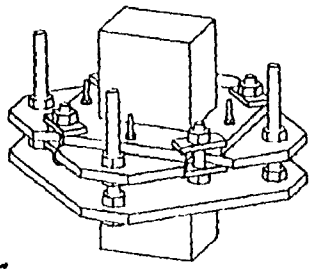
FIG 14C VIEW OF SHEAR PLATE AND BOLTS FOR REF.
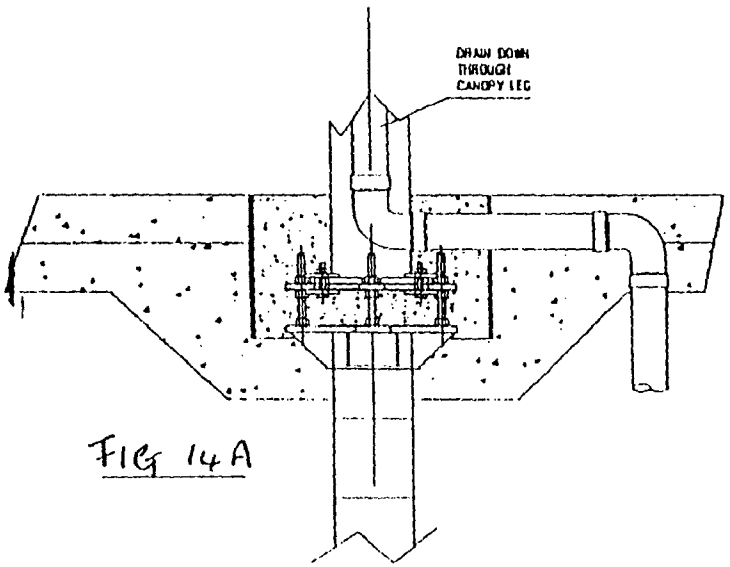
FIG 14A SIDE VIEW OF ISLAND IN THE DIRECTION OF THE LONG SIDE

STORAGE TANK ASSEMBLY

FIELD OF THE INVENTION

The present invention relates to an improved storage tank assembly design. It is particularly applicable, but in no way limited, to a storage tank assembly for use in a fuel distribution system, and especially for use in a pre-fabricated, modular fuel dispensing system.

BACKGROUND TO THE INVENTION

In a typical petrol/diesel or so-called gasoline dispensing station with an underground fuel storage system, dispensing pumps are arranged on an island with the fuel storage tank(s) situated away from the island. A canopy is supported on a separate foundation poured on site, the island being supported on a similar but independent foundation. The tank(s) are sited on a slab or with "dead men", polyester webbing bands or straps of wire rope to prevent uplift and rotation of the tank(s).

There are three main disadvantages of this arrangement. Firstly, multiple excavations and foundations have to be made for the tank(s), the island(s) and the canopy, all of which increases cost. Secondly, due to the distance between the tank(s) and the island(s) and therefore the pumps, the tank(s) need a deeper excavation to cater for pipe runs. In addition, this type of set up requires relatively long runs of pipe that may need joints along their length. This in turn increases the potential for ground contamination. Lastly, the site needs to be large enough to accommodate these various separate components.

Above ground fuel dispensing systems are also known and one such dispensing station is known from SE-B383707. In this case the foundation for the fuel station is arranged above ground. The fuel pumps and the frame structure for the canopy roof are mounted on top of this foundation. This arrangement with the above ground tank and the fuel pumps in front of it presents some problems. Firstly, due to the size of the foundation the fuel pumps can only be attended by the customers from one side. Secondly, there are security aspects to be taken into consideration. There is always the risk of explosion in the event that a vehicle or the like crashes into the fuel station. Furthermore, it is relatively easy for unauthorised personnel to gain access to the above ground fuel tank(s). Thirdly, seasonal temperature fluctuations must be considered because the expansion of fuel in the tank differs significantly with the temperature.

Attempts have been made to address some of these problems. For example, EP 0686105B1 (U-Cont Limited) describes an integral unit for the construction of a petrol filling station. It describes a tank, pump island and rain shelter pre-fabricated onto one, common foundation prior to location on the construction site. Built into the construction is a frame structure for the canopy roofing which is adapted to be supported directly on the foundation and thus the bearing loads are directed past and away from the fuel tank(s). As a result, the natural buoyancy of the tank(s) still presents problems in areas where there is a high water table or areas which are prone to flooding. The tank must therefore still be strapped down as in the previously described prior art. There are further disadvantages of this design. The storage tank sits inside a load-bearing framework. This means that if the tank develops a leak or has to be replaced for any reason the entire structure, including the foundations, has to be removed. In addition, the extent of the excavation needed to accommodate this type of construction is significantly larger than that required to accommodate a conventional tank alone.

U.S. Pat. No. 5,526,964 (Petro-First Inc) also describes a pre-fabricated modular fuel dispensing system. In this case the system includes a foundation module with an underground fuel reservoir to store fuel to be dispensed and a conduit containment trough to house fuel supply conduits and a fuel dispensing conduit. This fuel dispensing module includes a pump island which supports fuel dispensing devices and also supports a canopy roof and its supporting columns. The foundation module, fuel dispensing module and canopy module are configured to be integrated into a unitised, mutually supportive structure. However, the canopy supports can only be located at either end of the fuel reservoir in this design. In many circumstances, this is too restrictive to be practical, particularly in larger filling stations which require an extensive canopy roof.

It is an object of the present invention to overcome or at least mitigate some or all of the problems outlined above.

SUMMARY OF THE INVENTION

According to the present invention there is provided a storage tank assembly according to claim 1. For example, a storage tank assembly comprises:

(i) a storage tank;

(ii) support means comprising at least one load bearing reinforcement means extending around and attached to at least a portion of the outer circumference of the storage tank, the support means further incorporating at least one mounting leg to enable the support means to be connected to a canopy.

This arrangement ensures that forces are transmitted through and around the tank and down into the foundation that the storage tank assembly is mounted on. It avoids the need for multiple excavations and multiple foundations and enables a canopy roof, for example, to be mounted directly onto the storage tank at various points along its length.

Preferably the reinforcement means extends around substantially the entire circumference of the storage tank. This arrangement provides an optimum weight to strength ratio and transmits forces around the whole outer circumference of the tank.

Preferably the support means further comprises a base frame. The base frame provides a solid platform for the tank to rest on as well as anchoring points to prevent the tank from lifting or turning in use.

In a particularly preferred embodiment the tank and reinforcement means are detachably mounted with respect to the base frame.

Preferably the reinforcement means and the base frame are connected by means of down beam legs.

Preferably the support means further comprises a plurality of saddle supports spaced along the length of the storage tank. Saddle supports are known per se and can be incorporated easily into the present invention.

Preferably the base frame further comprises one or more cross beams, each cross beam being associated with a particular reinforcement means.

In a further preferred embodiment the saddle supports and/or cross beam(s) are linked to one another by longitudinal connections such that, in combination, they form a base frame which extends substantially the whole length of the tank.

Preferably the mounting legs are supported off a reinforcement means.

Preferably mounting legs are positioned on either side of the tank.

Preferably the mounting legs on a particular reinforcement means are positioned symmetrically about the centre line of the tank.

Preferably the mounting legs associated with a particular reinforcement means are spanned by a goal post-type support and wherein the goal post-type support incorporates a canopy-mounting bracket.

Preferably the canopy-mounting bracket is positioned above and substantially in line with the centre of the tank.

Preferably the storage tank is a doubled skinned tank.

In a preferred embodiment the reinforcement means is attached to the inner skin of the tank. This enables a secondary containment layer to substantially cover the inner skin of the tank.

In a still further preferred embodiment the reinforcement means is attached to the inner skin by means of a doubling plate. This simplifies construction of the secondary containment layer.

Preferably the reinforcement means comprises a box section, and preferably the box section reinforcement means is integrated into the secondary containment system.

In a particularly preferred embodiment the storage tank may incorporate internal baffle plates aligned with the load bearing reinforcement means and adapted to transfer load from the tank to the reinforcement means. These internal baffle or gusset plate structures provide additional stiffening and ensure that loads applied to the top of the storage tank are transmitted to and through the load bearing reinforcement means.

Preferably the tank assembly further comprises one or more access chambers.

Preferably the tank assembly further comprises a canopy.

Preferably the tank assembly further comprises one or more fuel dispensing pumps. In this manner a tank, access chambers, a complete canopy including canopy column supports can be delivered to site as a complete package. It is even possible to include dispensing pumps and their associated electrics as part of the package.

BRIEF DESCRIPTION OF THE DRAWINGS

The invention will now be further described, by way of example only, with reference to the accompanying drawings in which:

FIG. 14 shows the detail of a canopy-mounting bracket and shear plate assembly;

DESCRIPTION OF PREFERRED EMBODIMENTS

Embodiments of the present invention are described below by way of example only. These examples represent the best ways of putting the invention into practice that are currently known to the applicant, although they are not the only ways in which this could be achieved.

Figure 1:
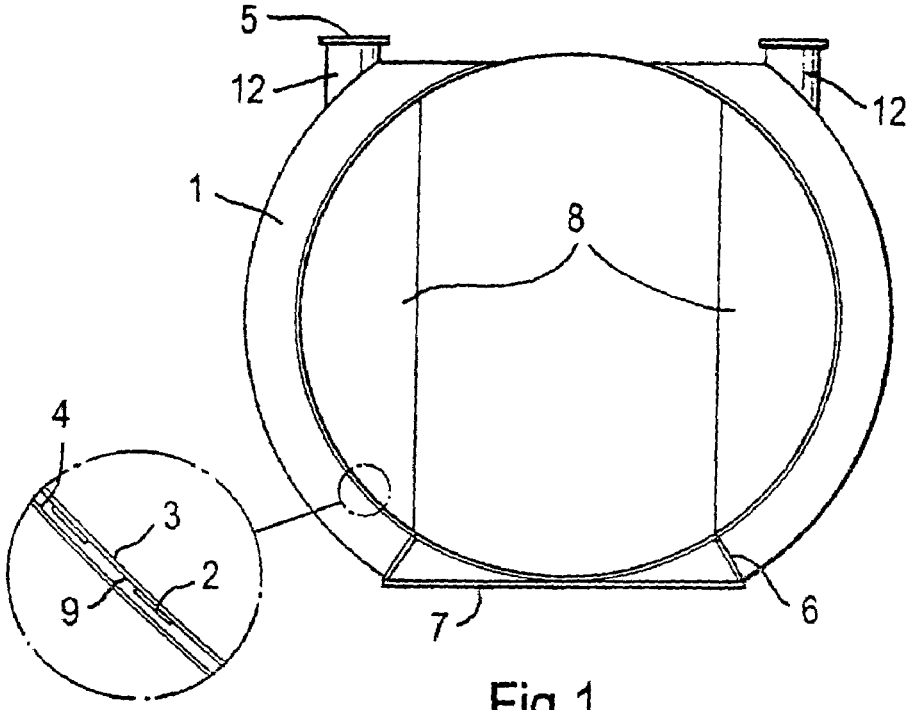
FIG. 1 illustrates a cross-sectional view of a storage tank assembly according to a first embodiment of the present invention.
Figure 2:
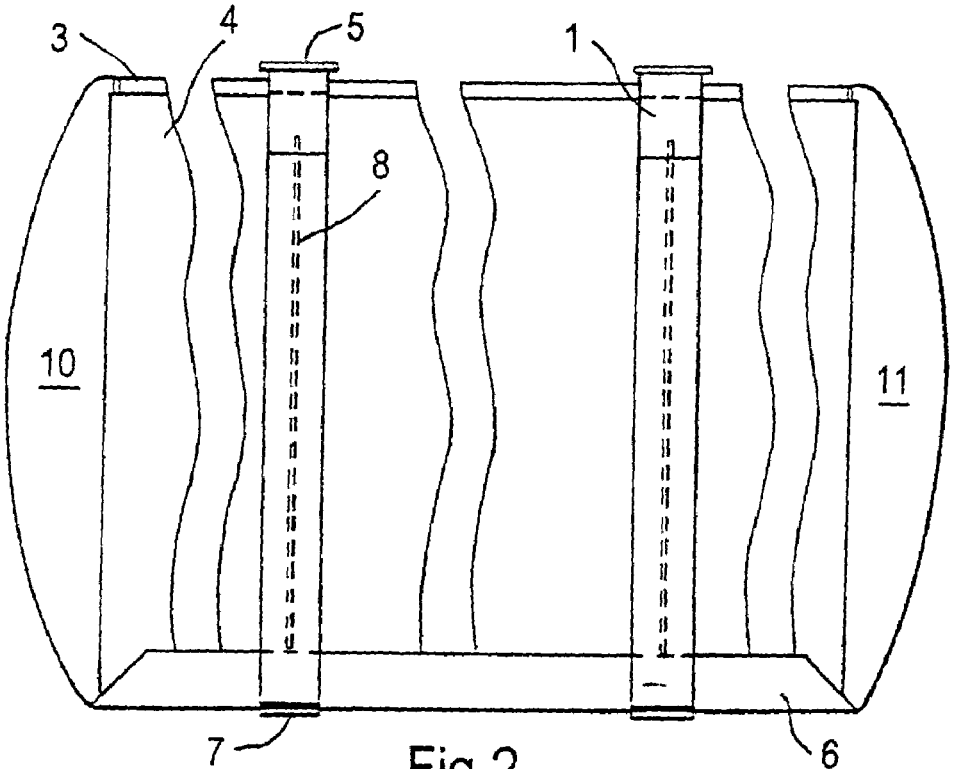
FIG. 2 illustrates a diagrammatic side elevation of the storage tank assembly shown in FIG. 1.

Referring to FIGS. 1 and 2, these illustrate a storage tank assembly comprising a storage tank made up of an inner or primary wall 3 and an outer or secondary wall 4. These walls are also referred to as skins. The inner and outer walls are spaced apart from each other to create an interstitial space 9. The inner and outer tanks are sealed at the ends by convex-shaped ends 10, 11 and each end also consists of a double skin. Thus, the interstitial space is continuous around substantially the whole surface of the outer tank.

Thus far, such tanks are known in the prior art and are conventionally used in petrol filling stations and the like for storing fuel to be dispensed. However, the storage tank assembly illustrated also incorporates reinforcement means 1 formed from crescent-shaped box sections, or other structural steel sections such as RSJ, UB, UC or RSC sections, extending around the sides of the tank. These structural supports may be welded directly to the outside of the inner wall 3 and each box section extends around approximately one-third of the circumference of the storage tank. With one such structural support on either side of tank, approximately two-thirds of the tank is encircled in this way. The opposing steel sections are connected at the base of the storage tank by a saddle support 7 which, as well as dispersing the load transmitted through the structural support sections, forms a rigid, stable base for the storage tank assembly.

Each set of crescent-shaped sections incorporates a saddle support 7 and these supports may be linked one to another by longitudinal connections or fins which may run substantially the whole length of the storage tank. The saddle supports are thus formed into a rigid framework and are arranged in substantially parallel corresponding end alignment fashion.

Figure 3:
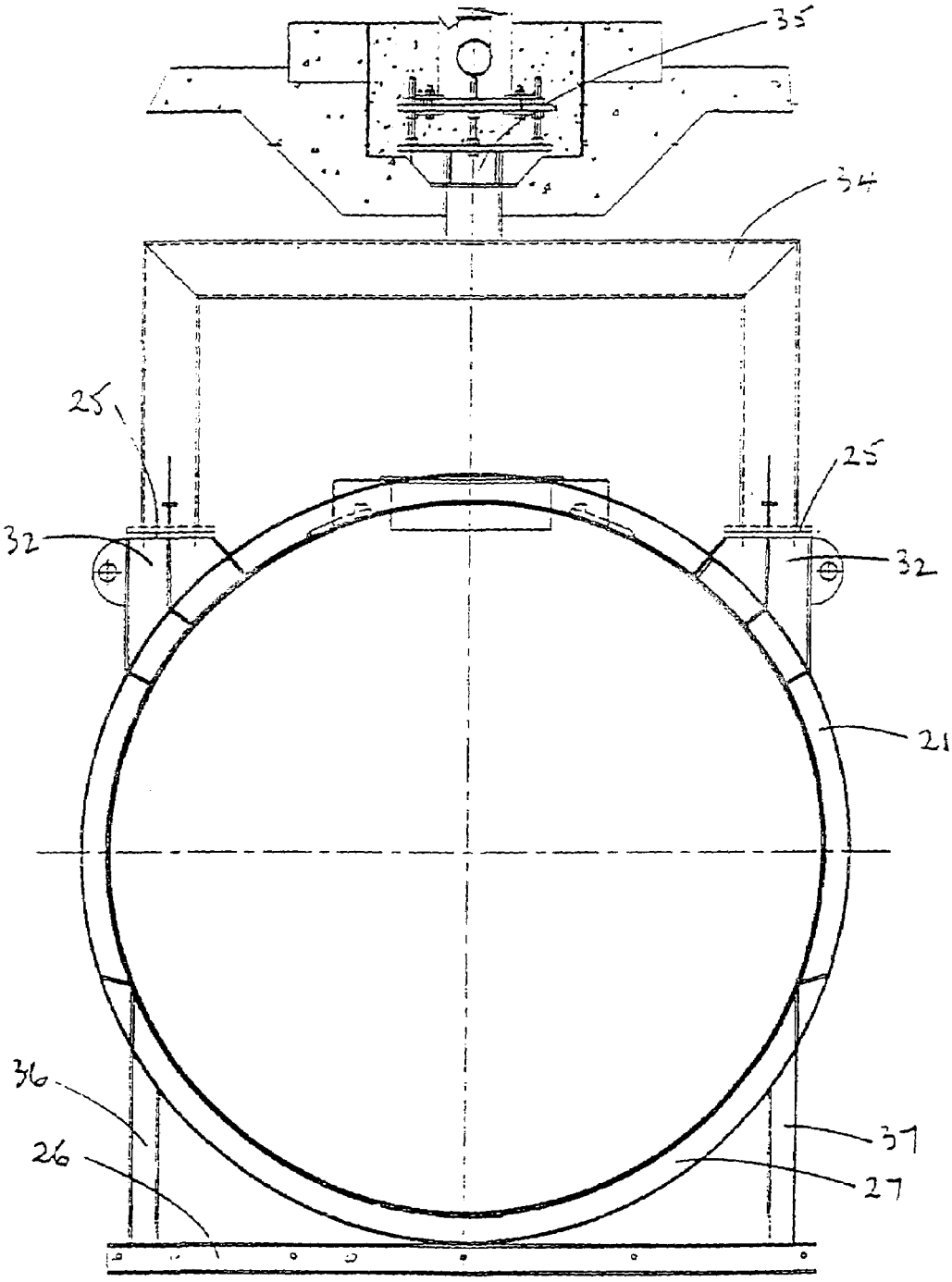
FIG. 3 illustrates a cross-sectional view of a storage tank assembly according to a second embodiment of the present invention.

In an alternative embodiment, shown in FIG. 3, the reinforcement means 21 or structural stiffening extends around substantially around the whole circumference of the tank. Thus, in comparison with the earlier embodiment, the structural supports, in combination with the saddle support, substantially encircle the tank. The reinforcement means therefore takes the form of a reinforcement ring. This arrangement has the advantage that the baffle plates 8 become redundant and can be reduced in size or eliminated entirely. There are no baffle plates shown in FIG. 3. A substantially circular-shaped reinforcement means is immensely strong and is particularly well adapted for transmitting loads around the tank.

In the context of a reinforcement means the term "structural support" has a broad meaning. It is intended to encompass any shape of reinforcement or structural stiffening. It includes box sections or other structural sections made of metal eg steel or other materials as recommended by the materials specialist.

Where the tank includes secondary containment then it is possible that the reinforcement means/structural support may form part of the interstitial space between primary and secondary layers. If this is the case then the structural section must be in the form of a fluid-tight compartment or compartments.

Importantly, the structural sections incorporate short, vertically extending legs 12, 32 terminating in mounting plates 5, 25. These are adapted to enable a canopy roof and its associated supporting columns, or other structures for that matter, to be mounted directly onto the load bearing reinforcement means box sections. The consequent load is distributed around the tank and ultimately onto the base framework 6, 7, 26, 27.

Where the storage tank incorporates a secondary layer, as in the illustrations, and where the reinforcement means is attached to the inner skin, it will be appreciated that this will be interrupted by structural sections 1, 21. However, by providing apertures 2 (see FIG. 1) through both legs of the box section fluid can pass freely around the whole interstitial space formed between primary and secondary skins. This is an important feature of this embodiment of the invention because, in effect, the box sections become part of the secondary containment system. With the exception of the apertures 2, the box sections must be fluid tight. The apertures 2 preferably take the form of slots or elliptical holes. Since the space between the two skins is usually limited, the profile of these apertures must also be limited so that they do not extend proud of the outer wall of the tank.

Figure 4:
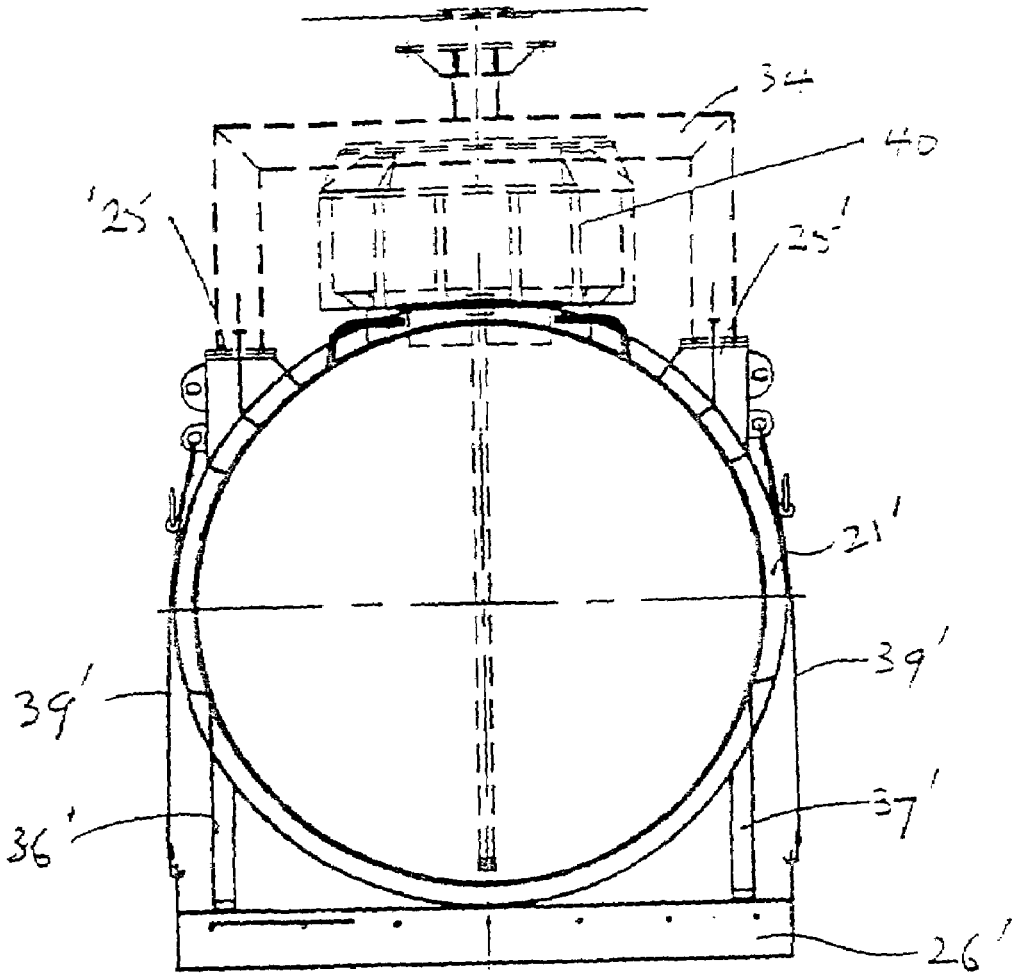
FIG. 4 illustrates a cross-sectional view of a further embodiment.
Figure 8:
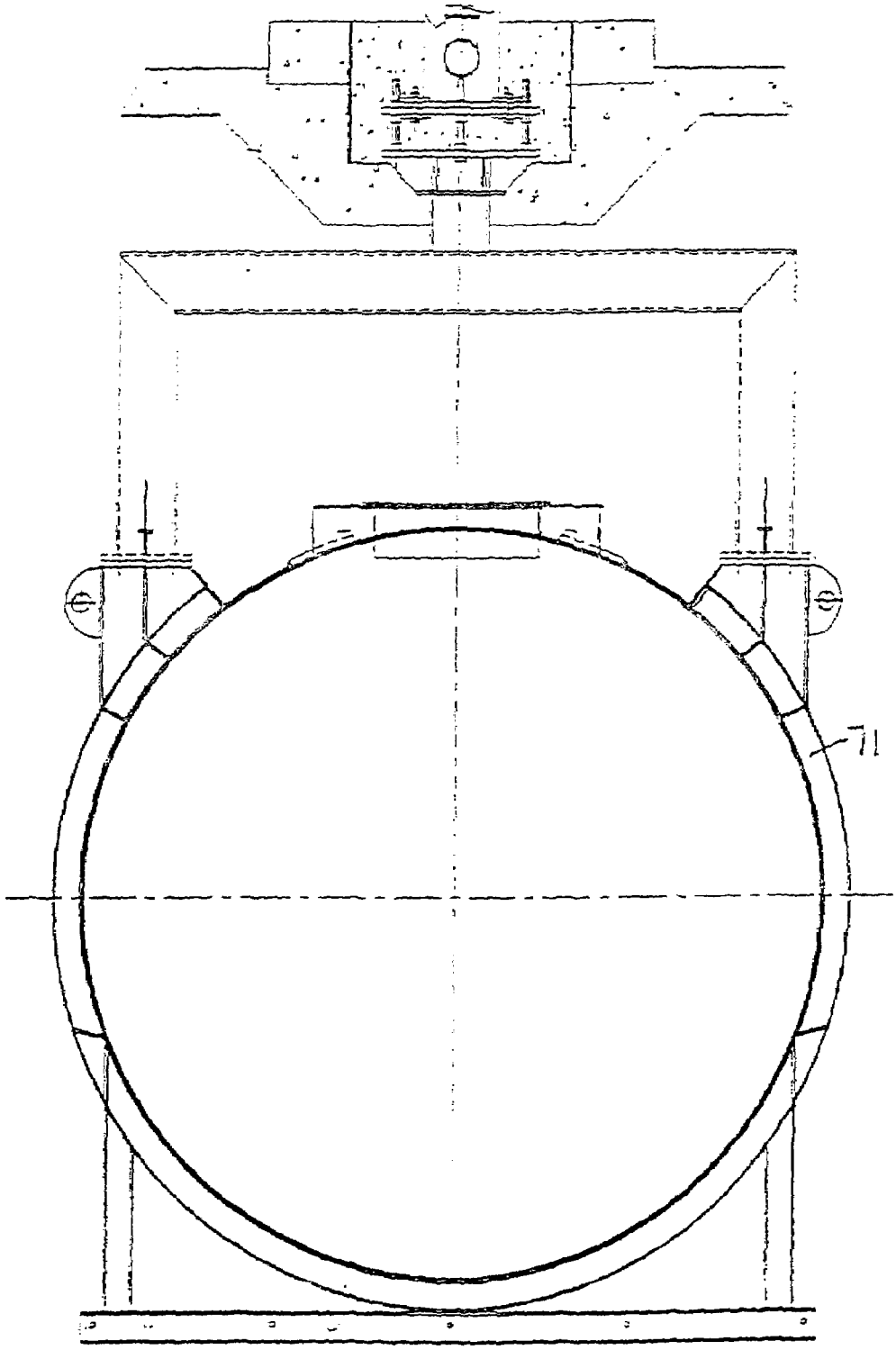
FIGS. 8 and 9 illustrate embodiments in which the load bearing reinforcement means extends partially rather than fully around the circumference of the tank.

The arrangements shown in FIGS. 3, 4 and 8 provide for a canopy mounting which is located substantially along the mid-line of the tank. In order to achieve this, two mounting plates 5, 25 are located on either side of the tank. These mounting plates are attached to vertically extending legs 12, 32 attached directly to the reinforcement means 1, 21. These mounting plates 5, 25 are spanned by a goal post-type support 34 which in turn supports a conventional canopy mounting bracket 35. In these examples the canopy-mounting bracket is located above and substantially in line with the centre of the tank. That is to say it is located at the opposite end of an imaginary vertical diameter line starting at the lowest point in the tank and joining the highest point of the tank. This, however, is only one possible arrangement. Two canopy mounting brackets could be provided, mounted directly on the mounting plates 5, 25. Alternatively a single canopy-mounting bracket could be provided mounted off one or other of the mounting plates. In a further alternative a single canopy-mounting bracket could be located centrally on the reinforcement means.

In a further important feature of the invention, down beam legs 36, 37 are detachably mounted to a crossbeam 26 which is part of a base framework. The advantage of this type of construction is that the tank and its associated reinforcement means can be detached from the base and removed for replacement or repair as required. This flexibility is not available in known systems. A preferred method of installing this new type of tank assembly is described later. This will further explain the advantageous nature of this arrangement.

FIG. 4 illustrates a rather more detailed cross-sectional view of the embodiment described above. FIG. 4 illustrates a double-skinned tank with a reinforcement means $\mathbf{21}^1$ in the form of a canopy support ring fully encircling the tank. Restraining straps 39' secure the canopy support ring $\mathbf{21}^1$ to a crossbeam $\mathbf{26}^1$. This cross beam is set in concrete during installation and the restraining straps prevent the tank lifting if the water table rises, or from rotating.

Figure 5:
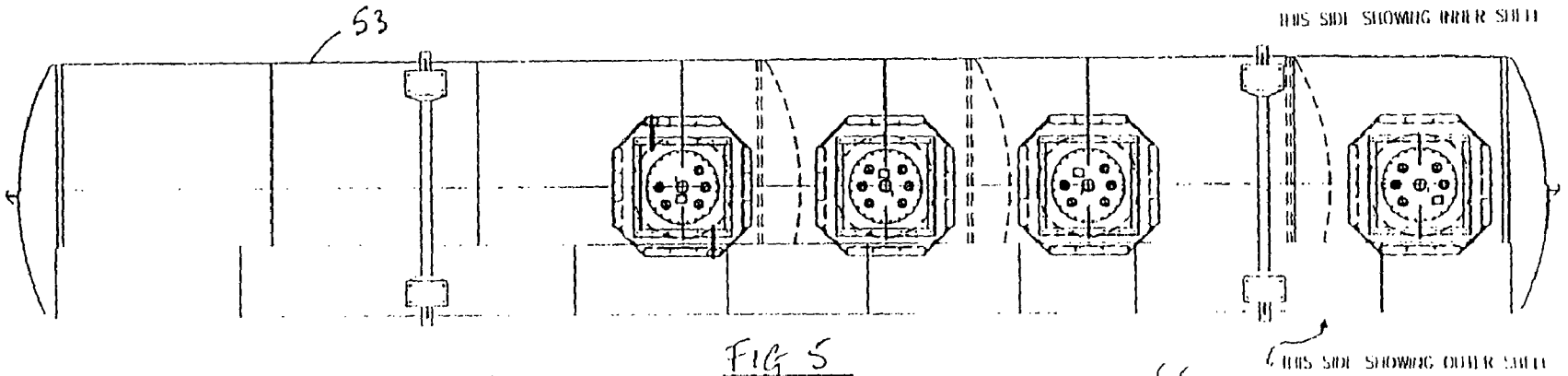
FIGS. 5 and 6 illustrate top and side elevations respectively of the assembly shown in FIG. 4.
Figure 6:
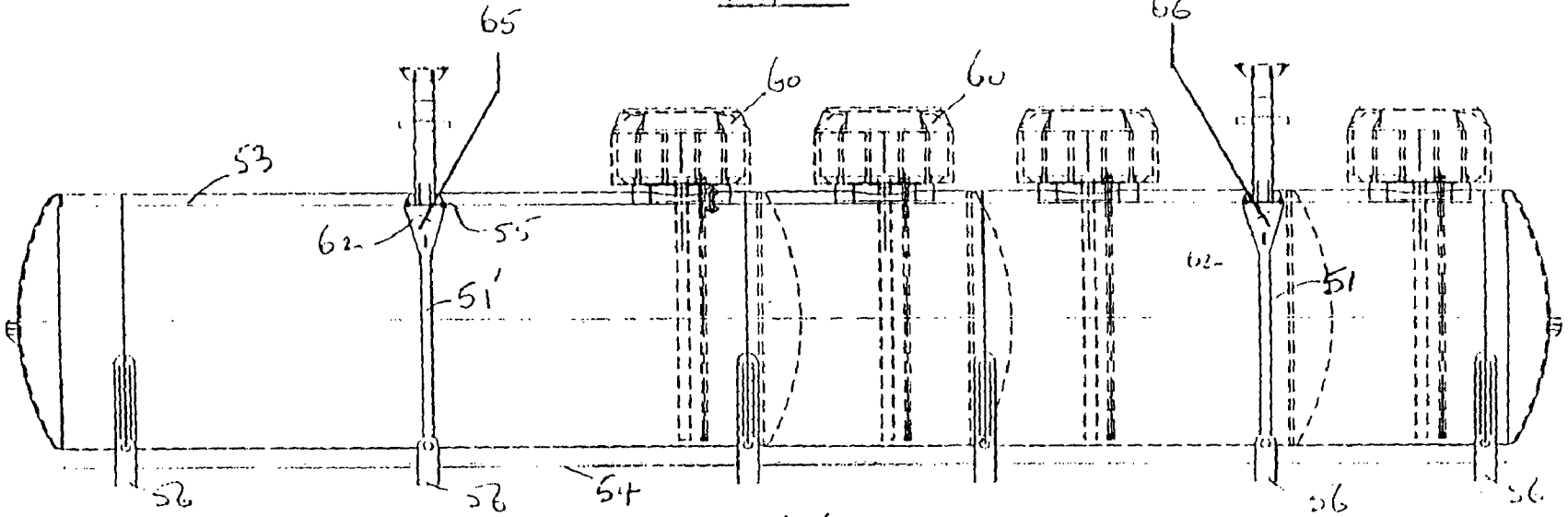

FIGS. 5 and 6 illustrate a tank assembly in a completed or partially completed state depending on how many components are to be included in the assembly. They illustrate a multi-compartment double skinned tank 53 mounted on a series of cross beams 56. These cross beams are linked together by longitudinal connections 54. At two points along the length of the tank there are positioned canopy support rings 51 and $\mathbf{51}^1$ which encircle the tank. These rings are also linked by longitudinal connections 54. The canopy support rings incorporate vertically extending legs 62, which can be tapered, terminating in mounting plates 55. This provides for the type of canopy mounting arrangement shown generally in FIGS. 3 and 4.

The location of the canopy support rings along the length of the tank can be varied to suit a particular forecourt and canopy layout. Their positioning can be varied within quite wide limits along the length of the tank.

Access chambers 60 can be provided, normally one for each tank compartment. Also provided are lifting chain or lifting cable eyes 65,66 so that the whole assembly can be lifted by crane and lowered into an excavation.

Figure 7:
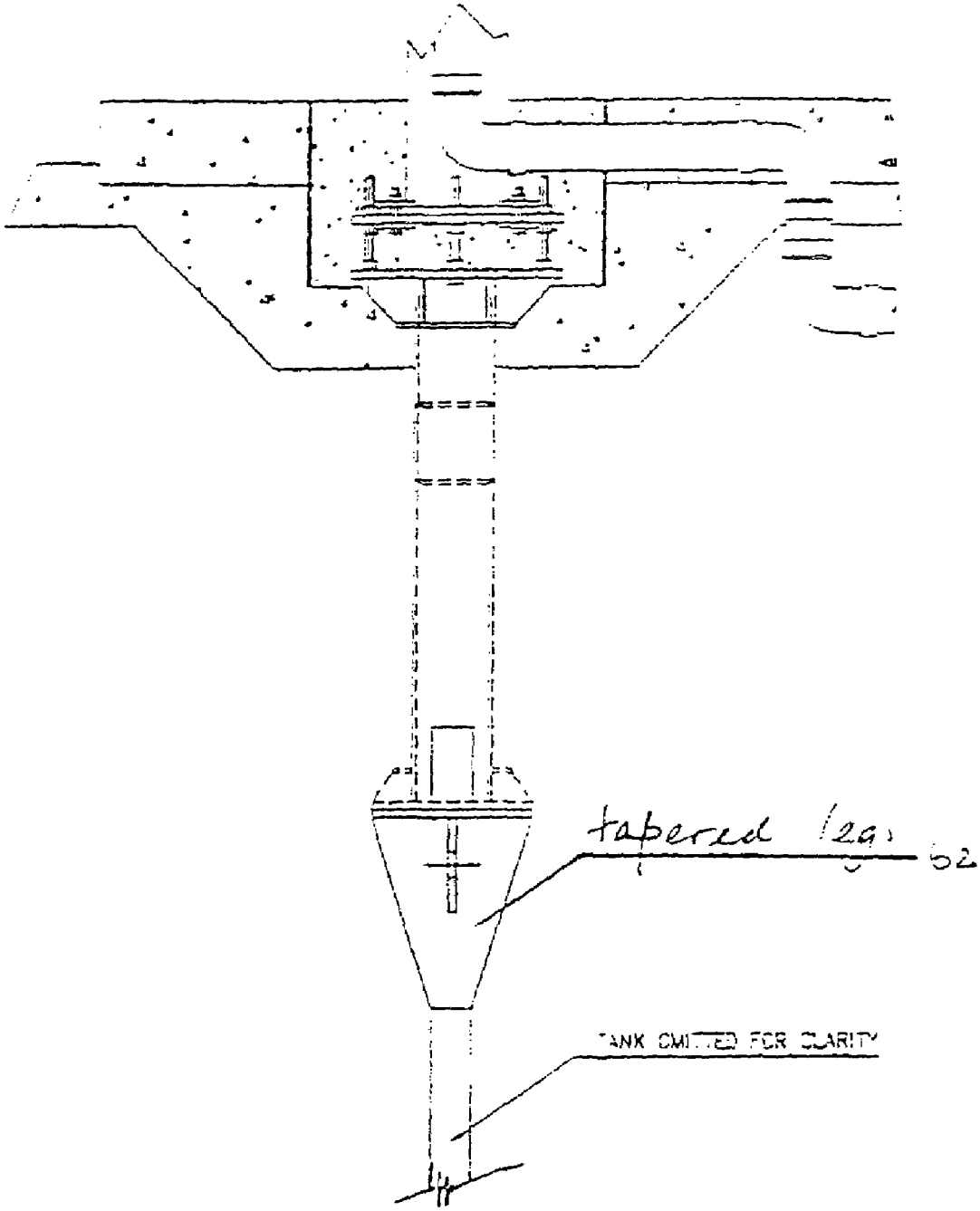
FIG. 7 shows a side elevation of a goal-post type canopy support of the type shown in FIG. 3.

FIG. 7 together with FIGS. 14A to D illustrate in more detail the arrangement associated with each canopy mounting bracket, and how these relate to the island on which fuel dispensing pumps are located.

Figure 9:
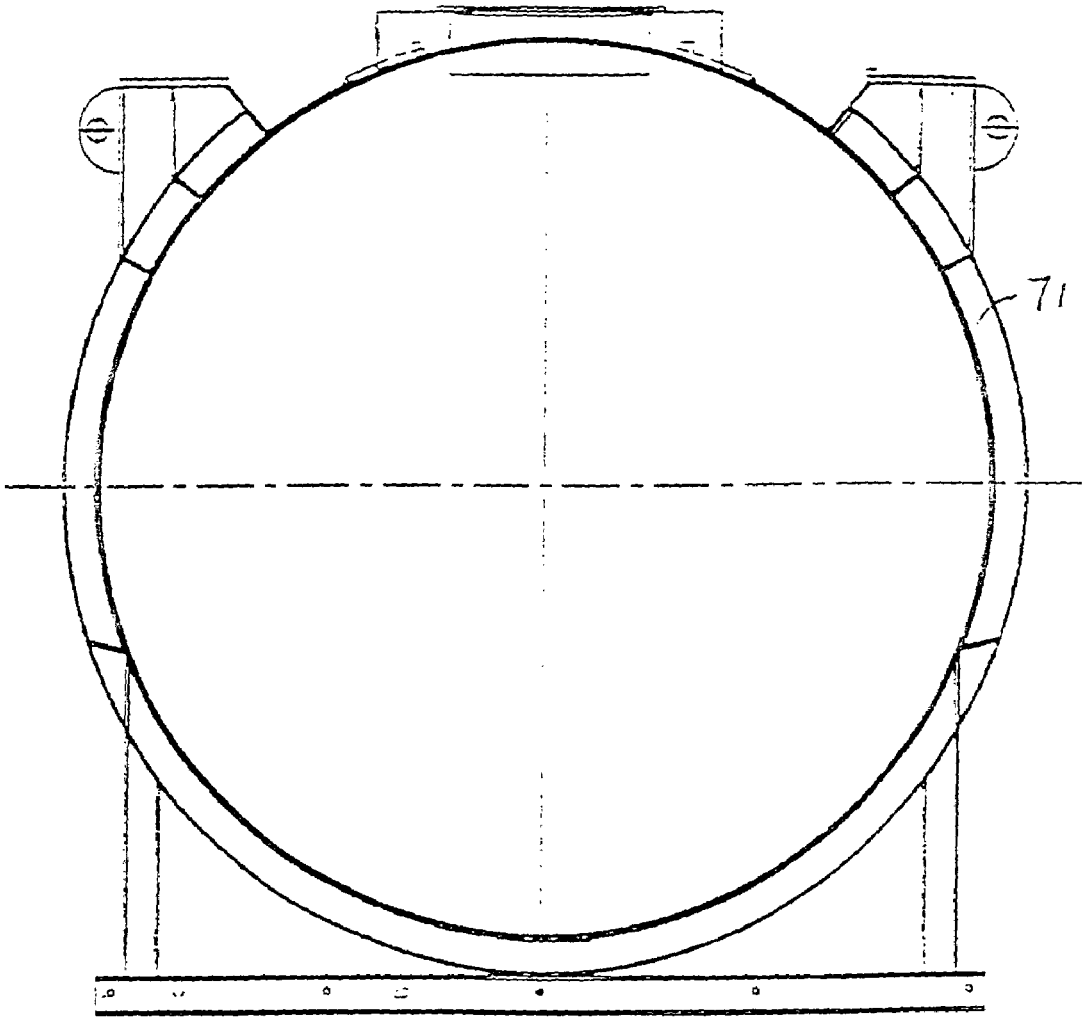

FIGS. 8 and 9 show a slightly different arrangement whereby the reinforcement means or canopy support ring 71 extends partially, rather than fully, around the tank. Other constructional arrangements remain the same as in FIGS. 3 to 7. Whilst some of the strength and rigidity inherent in a fully circular ring are lost, the weight of the canopy is still distributed around and through the tank.

There are a number of ways to attach a canopy support ring to a double skinned tank of the type in question. In the embodiment shown in FIG. 1 a u-shaped box section is tack welded around parts of the circumference of the tank. The steel sheets making up the secondary skin of the tank are then overlaid on the outwardly depending limbs of the u-shaped box section and welded to these limbs in a fluid-tight fashion. In this arrangement the inside of what is essentially a box section becomes part of the secondary containment system. It is therefore essential that the bod section arrangement is completely fluid-tight.

In a further arrangement, a so-called doubling plate is placed around the circumference of the tank. This plate takes the form of a steel strip whose width is greater than the width of the u-shaped box section. The doubling plate is then tack welded to the inner tank. The section is laid over the doubling plate and welded to it. The steel sheets making up the secondary containment system are then overlaid on the exposed edges of the doubling plate and welded to it in a fluid-tight fashion. In this manner the section does not become an integral part of the secondary containment system. This arrangement is considerably easier to manufacture.

Figure 10:
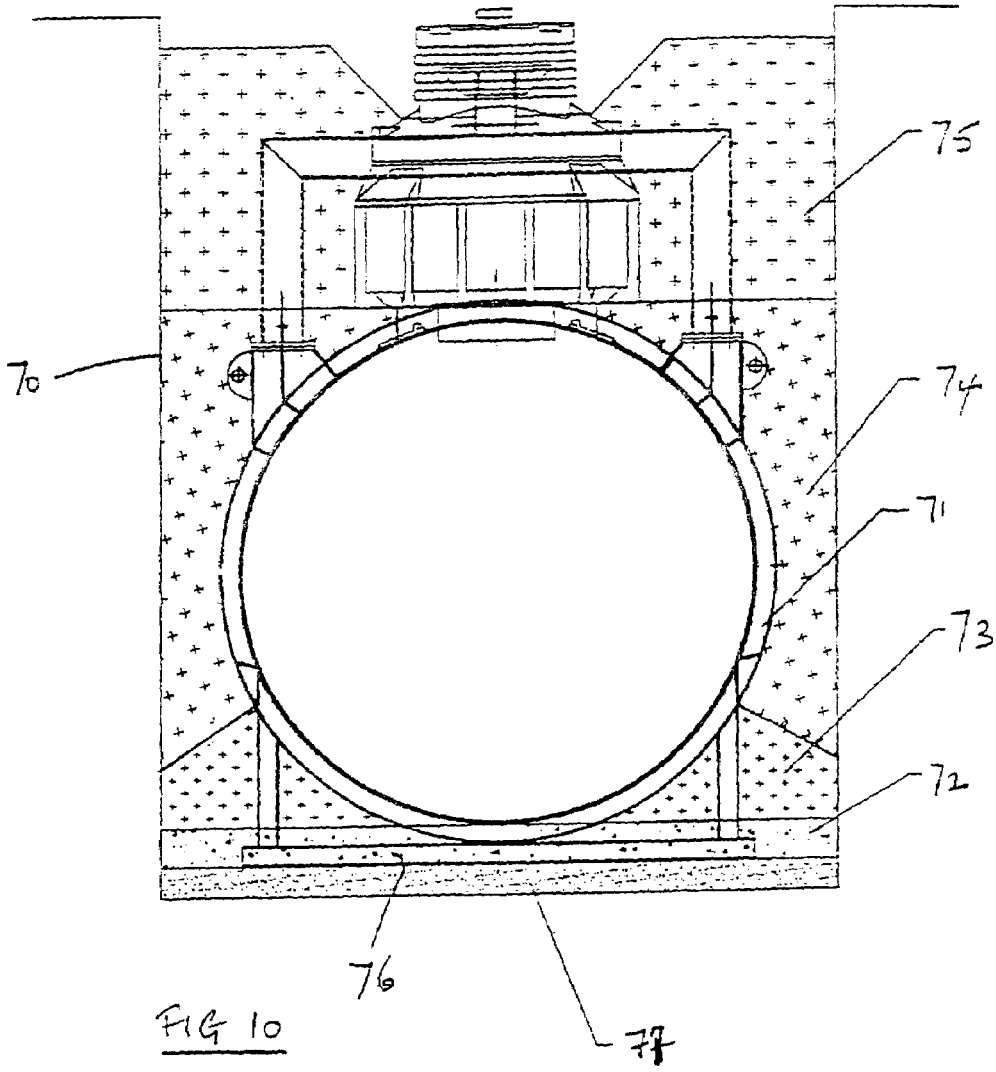
FIG. 10 illustrates a tank assembly according to the present invention set into the ground.
Figure 11:
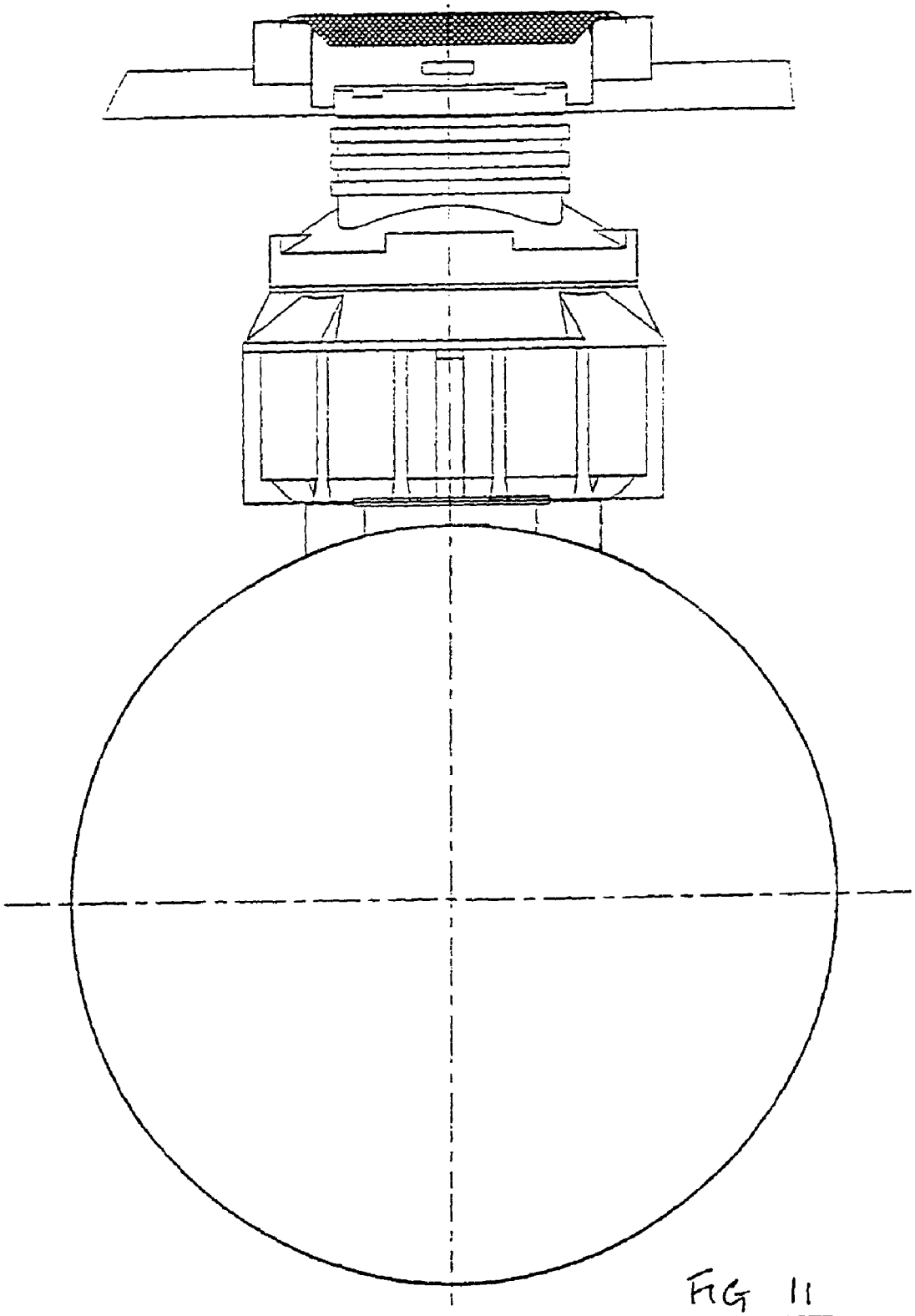
FIGS. 11 and 12 show end and side elevations respectively of a tank with an access chamber fitted.
Figure 12:
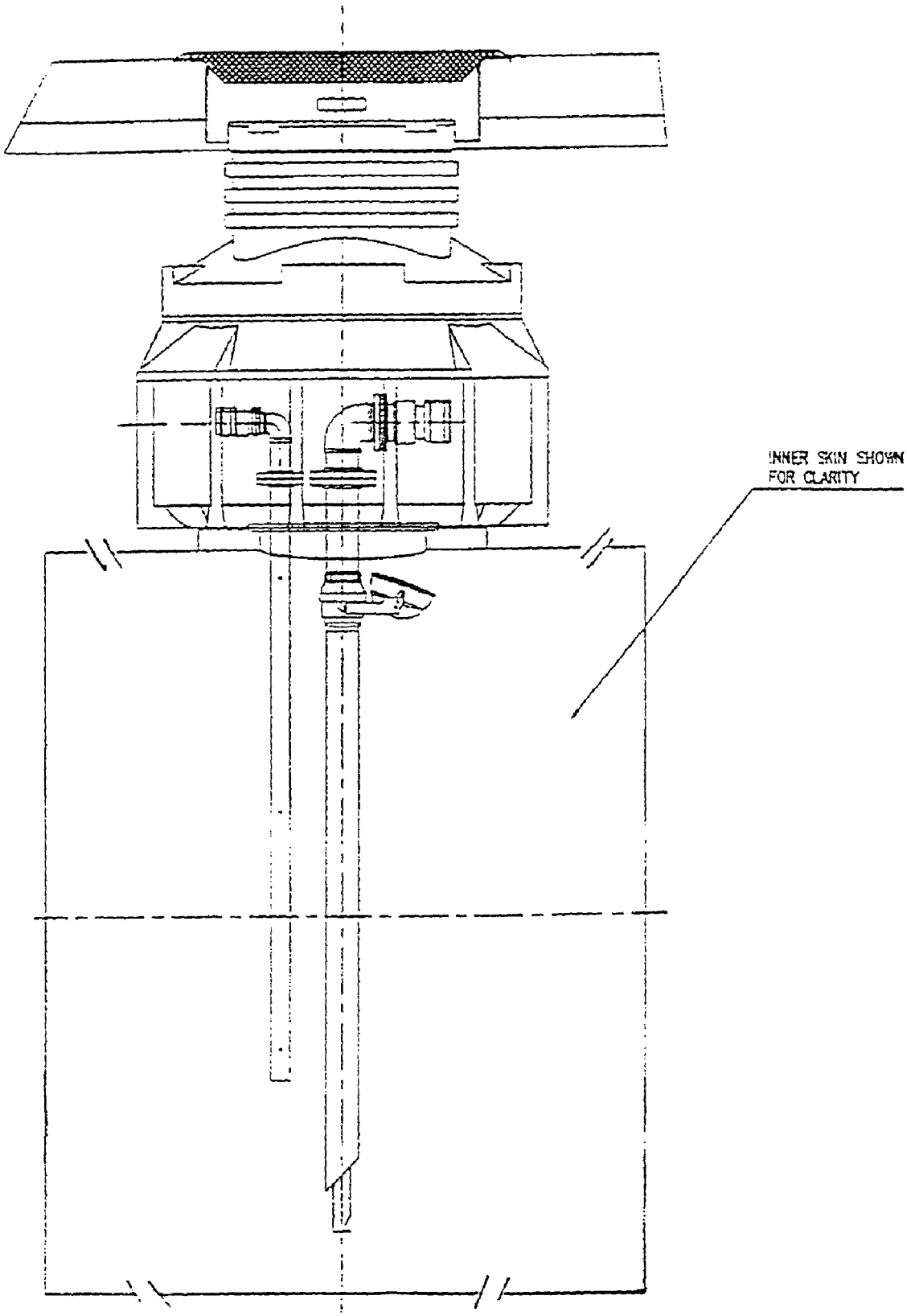

Turning now to the method of installation. This is shown most clearly in FIG. 10. A straight-sided excavation 70 is formed to the appropriate depth. A layer of stabilised sand (cement/sand mix) 77 is set firm in the bottom of the excavation. This allows the tank to be held level and allows for some positioning. Concrete 72 is then poured into the excavation to cover completely all the crossbeams. At some time prior to lowering the assembly into the excavation, usually at the works where the tank assembly is made, the cross beams are drilled and reinforcing bars fed through adjoining cross beams along substantially the entire length of the tank. Reinforcing mesh is then attached over the extent of the reinforcing bar area. This whole base frame construction then becomes encased in the concrete layer 72.

A layer of pea gravel, which is relatively self-compacting, is added. To prevent voids under the tank bottom all bedding and back-fill material must be packed under the lower 120° section of the tank bottom. The solid lines in FIG. 10 between regions 73 and 74 approximate to this 120° angle.

Compacted fill 74 is added up to the bottom of the access chamber to fully stabilise the tank and to allow additional pipework to be fitted at ground level. When this pipework and any other work is complete the remaining volume 75 is back-filled to allow fin grade to be constructed.

In the event that a tank has to be removed the various layers of back-fill 75, 74 and 73 are removed. The down beam legs 77, 78 are detached from the crossbeam 76 and the remainder of the tank assembly can be lifted out of the excavation for repair or replacement. Alternatively, the down beam legs can remain attached to the crossbeam 76 and instead the legs may be detached from the canopy ring 71. Both arrangements have the same end result, namely that the tank and canopy ring can be detached from the base frame which remains in situ.

Figure 13C:
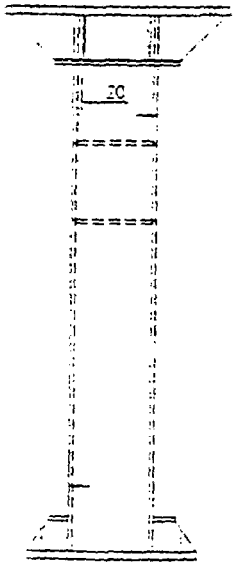
FIG. 13 illustrates various views of a goal post-type canopy support.
Figure 13B:
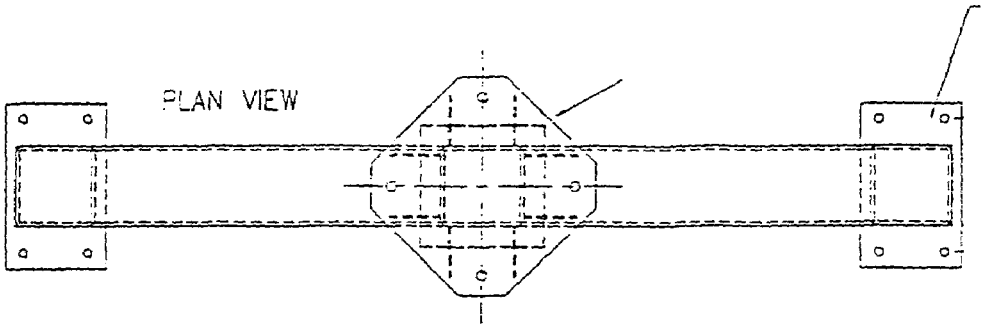
Figure 13A:
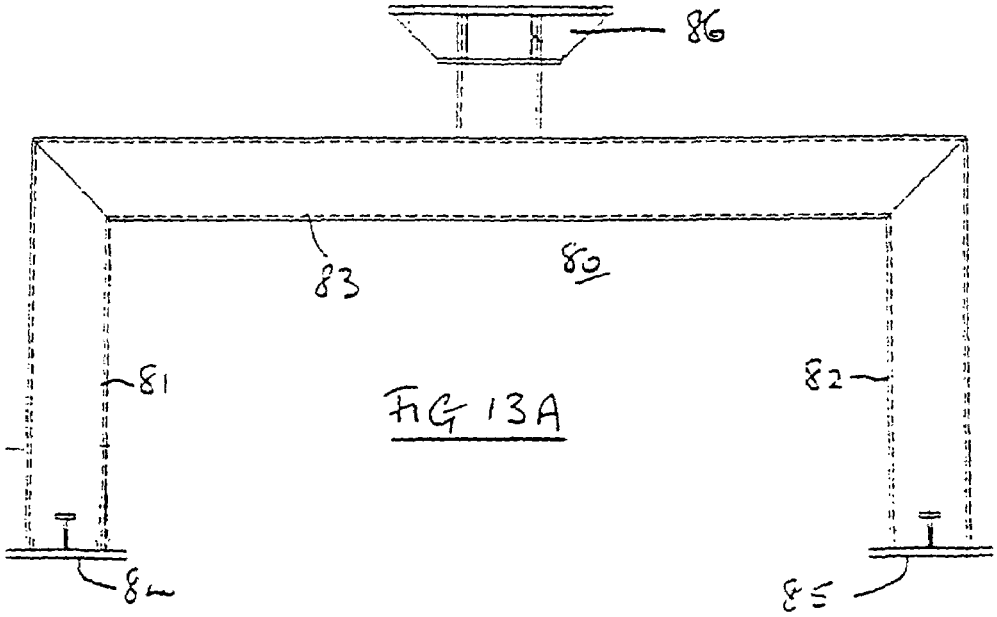
Figure 15:
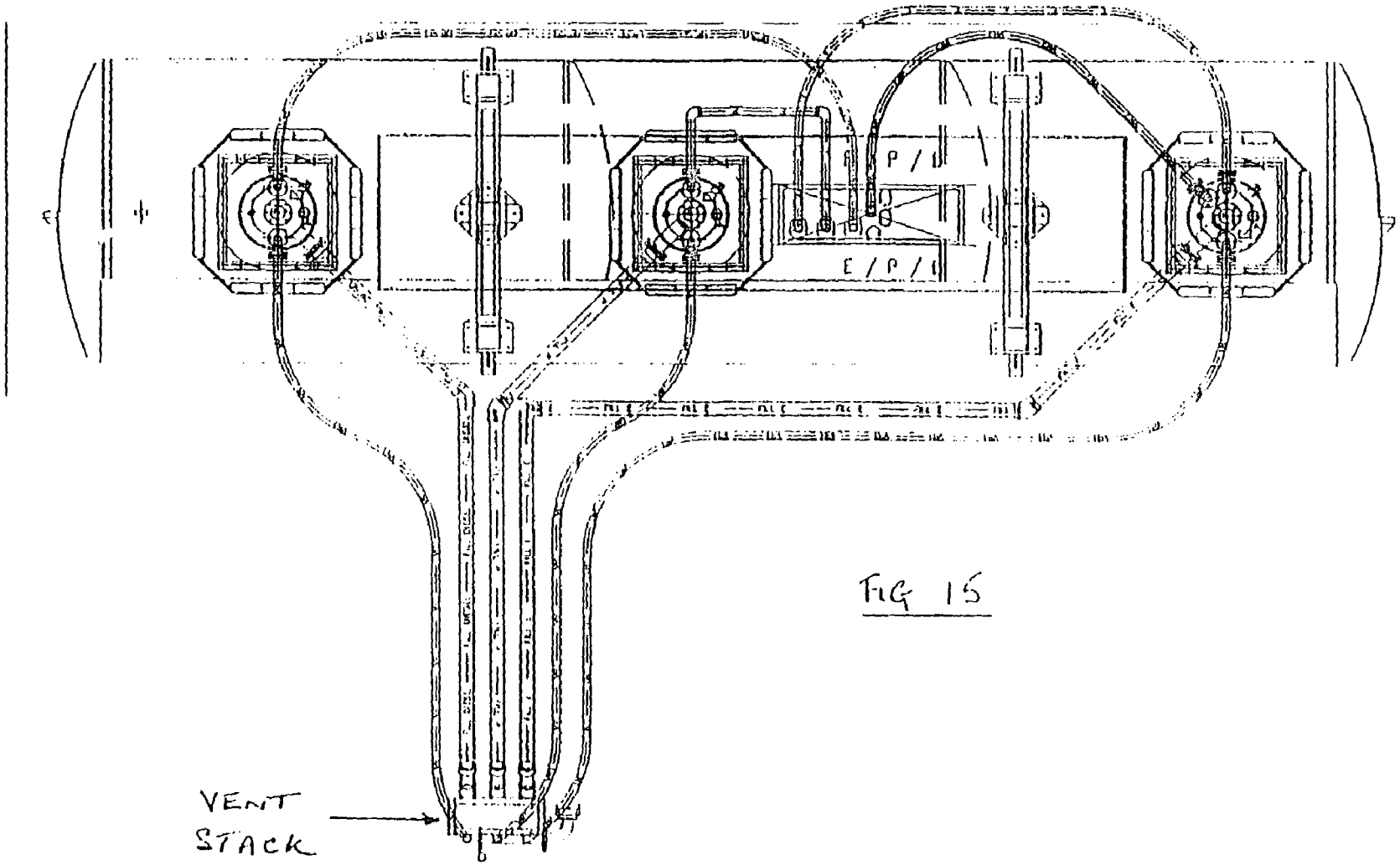
FIG. 15 illustrates the piping arrangement associated with a tank assembly according to the present invention.

FIG. 13 illustrates a typical goal post-type canopy support 80. Side elevation 13A shows two uprights 81 and 82 and spanning cross-member 83. Feet 84, 85 on the bottom of the uprights are a mating fit with mounting plates 5, 25 shown in FIGS. 2, 3 and 4. The cross-member 83 supports a canopy mounting bracket 86. Details of this canopy mounting are shown in FIG. 14.

It will therefore be appreciated that the present invention also relates to a fuel dispensing station, comprising at least one fuel tank (other tanks may be necessary), at least one fuel pump for dispensing fuel contained in said tank and a pump canopy which are assembled together as an integrated unit. The present arrangement transmits the forces from the weight of the canopy around the tank, and down into the foundation that is poured on site, or which may be cast in the factory and transported as a tank complete with concrete pads. This eliminates the formerly mentioned problems as follows:

a) Reduced excavations are required as there is one foundation which is poured after the tank is lowered and levelled in the excavation. Other foundations may be required for extended canopy or island(s) and pump(s) which are not handled within the invention area.
b) This arrangement eliminates the necessity for separate holding down straps and separate installation of same.
c) The tank is now located directly below the pump and so pipe runs are reduced.
d) As the tank is located below the island(s) the site can be smaller.
e) As the tank is now underground customers can dispense from both sides of the island.
f) Security is enhanced due to the tank(s) being underground and access chambers are less accessible to the public.
g) Temperature variations are reduced as tanks are underground.

The invention therefore provides in a first embodiment a storage tank assembly for a fuel dispensing station, an example of which is shown schematically in FIGS. 1 and 2. This is installed in an excavation, which has been backfilled to the correct depth and levelled. The tank comprises:

a primary skin 3 a secondary skin 4 if required ends to close 10, 11 (shown as dished type in FIG. 2).

'crescent' structures 1 including canopy supports 5, integral cradle/saddle support 7 and longitudinal sections 6. The 'crescent' may have semi-circular holes or slots 2 partially around the sides of the structure, when secondary skin is required to allow flow, pressure or vacuum flow through for leak detection to continue monitoring of the primary skin 3.

an internal baffle/gusset structure for additional stiffening 8 if required.

This assembly is lowered into the excavation, and checked for level and height, and then the cement foundation is poured to a predetermined depth, and compacted. This surrounds the base of the tank and the saddle(s) 7 and the longitudinal fins 6, which secure and stabilise the tank. This is then left to set, and then the backfill material is added and compacted around the tank to a height that allows piping of the station to take place. The canopy can then be connected directly onto the mounting plates 5, or through a 'goal post' structure (not shown), and then erected. The island(s) and pump(s) frame(s) can be fastened to assist piping and levelling, and then the piping can be laid. When tested, the backfill can be added and the normal forecourt arrangements completed.

The main features of the present invention can be summarised as follows:

A double or single walled, underground fuel storage tank which possesses the following additional features:

1. External circumferential reinforcement/stiffening welded directly to primary wall of fuel tank.
2. Integral vertical legs at the top of reinforcement/stiffening to be used for mounting structural support for future erection of forecourt canopy.
3. Integral bottom cradle/saddle supports (integral also with circumferential reinforcement/stiffening) used to mount tank inside underground excavation.
4. Bottom cradle/saddle supports may be linked longitudinally (along tank length) to form, with circumferential reinforcement/stiffening and integral vertical legs, a load bearing assembly for future erection of forecourt canopy.
5. The possibility for reinforcement inside tank to cater for any additional loads or to deflect any additional loads from tank to integral supporting structure if the loads cannot be catered for in the external reinforcement.
6. The whole assembly, ie tank, reinforcement internally, externally, vertical legs, cradles/saddles, longitudinal connections at bottom between circumferential sections, can be referred to as a framed, supported fuel system, skid mounted unit or similar designation. The frame/tank assembly will serve the purpose of holding down after pouring of concrete foundation.
7. The ability of the tank to cater for any imposed loading from ground bearing to canopy wind/overturning moments via the above system of reinforcement/stiffening base frame/skid mounting.

It will be appreciated that as well as the storage tank assembly the invention also encompasses a pre-fabricated, modular fuel dispensing system including optionally a pump island, fuel pumps and canopy roof.

This invention has been described with a tank of substantially circular cross-section. This is not essential. Any suitable cross-section can be used such as elliptical or rectangular cross-section. The reinforcement means or canopy support ring will simply follow the external profile of the tank. It follows therefore that the term "ring" in this context is not limited to a substantially circular annulus. Alternative geometric cross-sections are included within the definition. Furthermore, the so-called "canopy support ring" need not fully encircle the tank.

It is also not necessary, although it is desirable, for the reinforcement ring to be attached directly to the tank. It can be attached to a doubler plate or it can be connected by some other means. For the purposes of this disclosure this range of possibilities may be encompassed in the term "directly associated" with the tank.

What is claimed is:

1. A storage tank assembly comprising:

(i) a storage tank;

(ii) a support comprising at least one load bearing structural support extending continuously around at least one side of the storage tank thereby transmitting vertical loads received by the support through the support and not transmitting said vertical loads directly to the storage tank, said structural support connected with at least a portion of the outer circumference of the storage tank;

(iii) at least one mounting leg extending vertically above the structural support and connected thereto for interconnecting the support to a canopy.

2. A storage tank assembly according to claim 1 wherein the support further comprises a base frame connected to the at least one structural support.

3. A storage tank assembly according to claim 2 wherein the tank and structural support are detachably mounted with respect to the base frame.

4. A storage tank assembly as claimed in claim 2 wherein the structural support and the base frame are connected by means of down beam legs.

5. A storage tank assembly as claimed in claim 1, wherein the support further comprises a plurality of saddle supports spaced along the length of the storage tank.

6. A storage tank assembly as claimed in claim 5, wherein the base frame further comprises at least one cross beam, each cross beam being associated with a particular structural support.

7. A storage tank assembly as claimed in claim 6, wherein the saddle supports and the at least one cross beam are linked to one another by longitudinal connections such that, in combination, they form a base frame which extends substantially the whole length of the tank.

8. A storage tank assembly as claimed in claim 1, wherein the at least one mounting leg is supported off the structural support.

9. A storage tank assembly as claimed in claim 1, wherein said at least one mounting leg is positioned on either side of the tank.

10. A storage tank assembly as claimed in claim 9, wherein the at least one mounting leg associated with a particular structural support is connected to a goal post-type support.

11. A storage tank assembly as claimed in claim 10, wherein the goal post-type support includes a canopy-mounting bracket attached thereto.

12. A storage tank assembly as claimed in claim 11, wherein the canopy mounting bracket is positioned above and substantially in line with a center of the tank.

13. A storage tank assembly as claimed in claim 1, wherein the storage tank is a doubled-skinned tank.

14. A storage tank assembly as claimed in claim 13, wherein the structural support is attached to the inner skin of the tank.

15. A storage tank assembly as claimed in claim 1, wherein the structural support comprises a box section.

16. A storage tank assembly as claimed in claim 15, wherein the box section structural support is integrated into a secondary containment system.

17. A storage tank assembly as claimed in claim 1, wherein the storage tank includes internal baffles mounted therein.

18. A storage tank assembly as claimed in claim 1, wherein the tank assembly further comprises one or more access chambers.

19. A storage tank assembly according to claim 1, wherein the structural support extends around substantially the entire circumference of the storage tank.

20. A storage tank assembly comprising:

a storage tank;

a support comprising at least one load bearing structural support extending continuously around at least one side of the storage tank thereby transmitting vertical loads received by the support through the support and not transmitting said vertical loads directly to the storage tank, said structural support connected to at least a portion of the outer circumference of the storage tank;

at least one mounting leg extending vertically above the structural support and connected thereto; and a goal post-type support connected to said at least one mounting leg and extending above said mounting leg, said goal post-type support including a canopy mounting bracket attached thereto.

21. A storage tank assembly comprising:

a cylindrical shaped storage tank;

a first load bearing structural support extending continuously around one side of the storage tank;

a second load bearing structural support extending continuously around an opposite side of the storage tank;

a first mounting leg extending vertically above the first structural support and connected thereto;

a second mounting leg extending vertically above the second structural support and connected thereto;

a base frame attached to a lower portion of said storage tank and interconnecting said first and second structural supports; and wherein said first and second mounting legs are offset from a center line of the storage tank so that vertical loads received by the supports transmit loads through the respective supports and not directly to the storage tank.

22. A storage tank assembly, as claimed in claim 21, wherein:

said first and second structural supports and said base frame are connected by down beam legs extending from the first and second structural supports.

23. A storage tank assembly, as claimed in claim 21, wherein:

said base frame further comprises at least one cross beam associated with a corresponding structural support.

24. A storage tank, as claimed in claim 21, further including:

a goal post-type support having first and second ends, said first end of said goal post-type support connected to said first structural support, and said second end of said goal post-type support connected to said second structural support, and wherein said goal post-type support extends above said storage tank and traverses across said storage tank.

* * * * *